United States Patent [19]

Moore et al.

[11] 4,219,791

[45] Aug. 26, 1980

[54] ELECTRICAL INDUCTIVE APPARATUS

[75] Inventors: Curtis L. Moore, Sharon; Martin P. Seidel, Monroeville, both of Pa.

[73] Assignee: Westinghouse Electric Corp., Pittsburgh, Pa.

[21] Appl. No.: 963,619

[22] Filed: Nov. 24, 1978

[51] Int. Cl.[2] ..... H01F 27/08

[52] U.S. Cl. ..... 336/58; 106/40 R; 174/120 SR; 336/94

[58] Field of Search ..... 336/58, 60, 94, 196, 336/197, 185, 207; 106/40 R; 174/120 SR

[56] References Cited

U.S. PATENT DOCUMENTS

| | | | |
|---|---|---|---|
| 2,797,201 | 6/1957 | Veatch et al. | 106/40 R X |
| 3,133,821 | 5/1964 | Alford et al. | 106/40 R |
| 3,246,271 | 4/1966 | Ford | 336/94 |
| 3,256,105 | 6/1966 | Alford et al. | 106/40 R |
| 3,425,577 | 2/1969 | Copley et al. | 106/40 R |
| 3,611,225 | 10/1971 | Dakin | 336/58 |
| 3,683,495 | 8/1972 | Feather | 336/187 |
| 3,720,897 | 3/1973 | Feather | 336/60 |
| 3,775,719 | 11/1973 | Gainer et al. | 336/58 |

*Primary Examiner*—Thomas J. Kozma
*Attorney, Agent, or Firm*—D. R. Lackey

[57] ABSTRACT

Electrical inductive apparatus including an electrically insulated electrical winding, an insulating dielectric surrounding the winding, and an insulating member associated with the winding which projects into the insulating dielectric. The insulating member includes a solid adhesive binder, and a filler of microspheres. The binder and microspheres are selected such that the dielectric constant of the insulating member is less than about 3.5 times the dielectric constant of the insulating dielectric.

11 Claims, 5 Drawing Figures

ELECTRICAL INDUCTIVE APPARATUS

BACKGROUND OF THE INVENTION

1. Field of the Invention

The invention relates in general to electrical inductive apparatus, such as power transformers, and more specifically, to new and improved insulative mechanical support structures in such apparatus.

2. Description of the Prior Art

The distribution of an A.C. voltage, and thus the dielectric stress, across two insulating materials or dielectrics in series, divides inversely with their dielectric constants. Thus, for an insulating structure in which two dielectrics are in series, it would be ideal if the material having the lowest dielectric strength would have the highest dielectric constant. The high dielectric constant material would transfer electrical stress into the lower dielectric constant material, which would have the dielectric strength to accommodate the higher electrical stress. Each material would be stressed according to its capability, and the dimensions and clearances of the insulating structure could be optimized to construct electrical inductive apparatus, such as power transformers and electrical reactors, smaller and lighter, thus lowering their cost.

Since solids generally have a higher per unit dielectric strength than gases or liquids, the preferred dielectric constant of solid insulation, when placed in series with a gas or liquid dielectric, should be lower than the dielectric constant of the associated gas or liquid. Unfortunately, available solid materials have dielectric constants which are opposite to that desired, i.e., 4 to 6 for solids, close to 1 for gases and vapors, and close to 2 for insulating liquids, such as mineral oil. Thus, the insulating structures which make up an electrical power transformer are designed accordingly, using insulative shapes and dimensions which will not exceed the electrical breakdown strengths of the various insulating materials utilized.

Liquid filled electrical inductive apparatus, in general, has excellent economically attractive materials available, such as mineral oil which has a dielectric constant in the range of 2.0 to 2.2, and Kraft paper, which when soaked with mineral oil, has a dielectric constant of about 3.75. While liquid filled electrical inductive apparatus may be reduced in size and weight by using a solid having a dielectric constant lower than that of oil soaked Kraft paper, any substitute for this solid insulation must not offset the potential cost savings, by its own higher initial cost. In addition, it must have the necessary physical characteristics, electrical strength, and chemical compatiblity essential to enabling such apparatus to operate for many years at an elevated operating temperature, while being subjected to lightning and switching surges on the connected electrical transmission and distribution lines.

Various substitutes for cellulose in liquid filled electrical inductive apparatus have been found, using certain organic plastic materials. For example, U.S. Pat. No. 3,611,225, which is assigned to the same assignee as the present application, discloses solid insulation formed of an organic resin binder, filled with an organic resin filler, with the latter being selected to lower the dielectric constant of the resulting composite structure. Materials are disclosed which will lower the dielectric constant of the solid to 2.7, for example. U.S. Pat. No. 3,775,719, which is also assigned to the same assignee as the present application, discloses solid insulation for liquid filled electrical inductive apparatus having a dielectric constant in the range of 2 to 2.7. The solid insulation is selected from at least one of the group consisting of thermosetting cross-linked 1, 2-polybutadiene hydrocarbon resins and copolymers thereof, and at least partially crystalline isotactic polystyrene. U.S. Pat. Nos. 3,683,495 and 3,720,897, which are also assigned to the same assignee as the present application, disclose the use of solid and foamed plastic materials, respectively, to form certain insulative structures which also have certain mechanical advantages, in liquid filled electrical inductive apparatus.

Even though inventions have been made which could replace cellulose in liquid filled transformers, the dielectric constant of oil impregnated cellulose is acceptable, oil impregnated cellulose has a very high electrical breakdown strength, and it is economically attractive. Thus, there has been no strong pressure to deviate from the long established use of cellulose in electrical power apparatus of the liquid filled type.

In the past, when liquid filled electrical inductive apparatus was to be operated near building and/or people, they have been constructed with a polychlorinated biphenyl liquid (PCB), instead of mineral oil, because of the fire resistant character of the PCB's. The Federal Toxic Substance Control Act, passed in 1976, has made it mandatory that the use of PCB's in such apparatus be phased out over a short period of time. The relatively high cost of substitute liquids has focused attention on alternatives, such as the use of air cooled, gas cooled, and gas/vapor cooled transformers. The design of such gas, and/or gas/vapor transformers in voltage and KVA ratings required to replace PCB filled apparatus, with adequate mechanical short circuit strengths, and costs which are competitive with PCB filled transformers, has highlighted the fact that a need exists for a low cost insulating material for use in gas or gas/vapor, which has a dielectric constant of 3.5 or less, and preferably 2.5 or less, as the gases and gas/vapor combinations have a dielectric constant of near 1. Known insulating materials which have a relatively low dielectric constant, such as wholly aromatic polyamide paper (Nomex), are very costly, making it difficult to provide a gas or gas/vapor transformer which is competitive costwise with liquid filled electrical inductive apparatus, which may conveniently use cellulose.

A high dielectric constant solid material which penetrates a non-uniform or highly stressed dielectric field in a gaseous dielectric, can cause very low corona inception voltages and low dielectric breakdowns, compared with either no solid spacers, or solid spacers which are terminated within a more uniform field. Thus, certain desirable and conventional arrangements of coil and winding supporting spacers, such as those used in liquid filled apparatus, are denied use in gas and gas/vapor applications because of high dielectric constant spacers penetrating non-uniform fields in an insulating dielectric having a dielectric constant of near 1. In addition to meeting the dielectric constant and cost factors, the insulating material must also have the high mechanical strength, both compressive and flexural, necessary to withstand short circuit forces, and it must be compatible thermally and chemically in its intended operating environment.

SUMMARY OF THE INVENTION

Briefly, the present invention is new and improved electrical inductive apparatus having a winding adapted for connection to an electrical potential at power frequency (50 or 60 Hz.), surrounded by an insulating dielectric. The winding includes solid insulation in the form of one or more structural shapes which add mechanical strength to the structure, while performing any one of a plurality of different electrical insulating functions, such as providing insulation between different sections of the windings, providing insulation between the winding and ground, and/or providing insulation between the winding and other windings, either of the same phase, or of different phases. The solid insulation is formed of an adhesive binder, such as an organic resin, and a filler which includes microspheres. The microspheres, which may be a manufactured product formed of glass, or fly ash microspheres, are present in concentrations of about 25% to 75% by weight, depending upon the binder used and the desired dielectric constant. The diameter of the microspheres is preferably 100 microns or less. However, larger diameter microspheres may be used, depending upon the electrical stress they will be subjected to. The microspheres have a very thin wall, giving them a dielectric constant of close to 1, enabling very low dielectric constant structural members to be molded, cast, extruded, or pultruded, when using normal adhesive binders, such as epoxy or polyester resins which have a dielectric constant in the range of 3 to 4. While the microspheres function to reduce the dielectric constant of the resulting structure by adding gas such as air, advantage is taken of the fact that a gas, in minute dimensions, has a very high electrical strength in volts per mil. The microspheres add gas in carefully controlled finely divided amounts, enabling insulating structures of exceptionally high electrical strength to be manufactured, with very high corona inception and breakdown voltage levels achievable, even when using low cost, non-critical manufacturing processes. Further, the microspheres in a resin binder enable structures to be made having the requisite mechanical strengths, even at the elevated operating temperatures of conventional electrical inductive apparatus, and the binder is selected to provide a structure which is chemically compatible with the surrounding insulating dielectric. The surrounding dielectric may be air, an insulating gas such as $SF_6$, or nitrogen, an insulating vapor from a liquid vaporizable within the operating temperature range of the apparatus, such as $C_8F_{16}O$ and $C_2Cl_4$, and insulating liquids such as mineral oil or silicone oil.

BRIEF DESCRIPTION OF THE DRAWING

The invention may be better understood, and further advantages and uses thereof more readily apparent, when considered in view of the following detailed description of exemplary embodiments, taken with the accompanying drawings, in which.

DESCRIPTION OF PREFERRED EMBODIMENT

Figure 1:
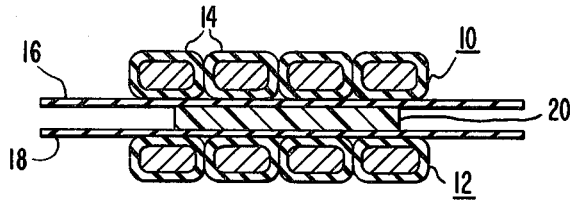
FIG. 1 illustrates a test setup for determining corona inception voltage levels utilizing an insulating spacer member arrangement which is required when a spacer of high dielectric constant is used within a gaseous dielectric.

A power transformer used in the transmission and distribution systems of the electrical utilities, must be able to withstand severe mechanical stresses caused by fault currents, in order to assure reliability of the power system. In a conventional core-form transformer, for example, a repulsive force is produced between the concentrically disposed high and low voltage windings of each phase, which forces the high voltage winding outwardly, and the low voltage winding inwardly. This force, which is the integral of the forces of all individual forces, can be visualized as acting between the electrical centers of the two windings. Since the electrical centers will almost always be offset due to taps and other irregularities in the windings, a force component is produced which tends to separate the windings axially, i.e., to move one winding up and the other down. Under normal load current, the forces are relatively small, but upon a short circuit the forces become very high. For example, in a three phase, 15 MVA, 15 KV, 5.5% impedance 60 Hz. core-form power transformer, the total force of repulsion between the high and low voltage windings might be 2,750 lbs, per phase. Upon a short circuit, the current may only be limited by the transformer impedance, and thus may be as high as 18.2 times normal. Since the resulting force is proportional to the square of the current, the short circuit force per phase would exceed 900,000 pounds. Also, the displacement of the first half cycle of current, with reference to the neutral axis, may be as high as 87% displaced for small and medium sized power transformers. This displacement increases the short circuit force 3.5 times the value with symmetrical current. Thus, in the example, the peak force of repulsion per phase would now be over 2,700,000 pounds.

Thus, the coils of the windings, and the coil bracing, must be designed to withstand these tremendous short circuit forces. The winding, as a unit, must be kept in place, and each turn, layer, section and part coil thereof, along with the insulation between them, must be left in their respective relative positions and they must not be damaged.

In addition to designing the windings to take such forces without damage, the designer must take into account heat removal, and thus cannot simply pack the conductor turns and coils into a tight homogeneous mass. Openings and ducts in the windings must be provided for circulation of the surrounding fluid insulating and cooling dielectric, liquid or gas, which increases the difficulty of designing the required mechanical strength into the structure.

An additional problem is imposed upon the designer when the insulating fluid is a gas, i.e., air cooled, gas cooled, or gas/vapor cooled transformers. Gases and vapors have a dielectric constant of near unity. The dielectric constant of conventional insulating spacers is between 4 and 5. As explained in the Description of the Prior Art, if a high dielectric constant spacer member protrudes into an area of non-uniform or high electrical stress, it can cause low corona inception voltages and low dielectric breakdown voltages, compared with no solid spacers, or spacers which are terminated within a more uniform field.

Figure 2:
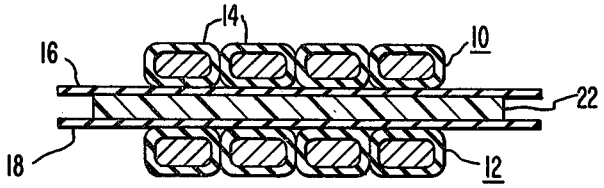
FIG. 2 illustrates a test setup similar to that of FIG. 1, except with an insulating spacer arrangement which may be used when the spacer is constructed according to the teachings of the invention.

FIGS. 1 and 2 illustrate test setups which highlight the problem caused by a large difference in the dielectric constants between solid insulating members and a surrounding fluid dielectric. FIG. 1 illustrates two pancake coils 10 and 12, in section, each of which have a plurality of insulated conductor turns, such as turns 14 in coil 10. Layer type sheet insulation 16 and 18 is disposed adjacent to each coil, and a solid insulating spacer member 20 is disposed between the sheet insulation to space the coils, in the same manner as the radial spacers in conventional circular core-form transformer construction. It will be noted that the spacer member 20 is terminated within the inner and outer edges of the coils, within a uniform electric field.

FIG. 2 is similar to FIG. 1, except a spacer member 22 is provided which extends past the inner and outer edges of the coils, thus protruding into the nonuniform, highly stressed area adjacent to the outer and inner edges of the coils. The FIG. 2 arrangement is preferred, from the mechanical standpoint, as it allows vertical insulating members to extend through holes or wedge shaped openings in the protruding portions of the spacers, to mechanically join the radial spacers of all vertically aligned spacers of the complete winding assembly, which has a large plurality of pancake coils.

The FIG. 2 arrangement is used in liquid filled power transformers, as the mismatch between the dielectric constant of the liquid, i.e., 2.2 for mineral oil, and the spacer, about 3.8 for oil soaked cellulose, is acceptable. However, when the surrounding dielectric is a gas, which has a dielectric constant of near 1, the corona inception and breakdown levels are seriously degraded.

In tests performed in air with spacer members 20 and 22 formed of pultruded polyglass having a dielectric constant of 4 to 5, the corona inception voltage for the FIG. 1 arrangement was 32 KV, while it was only 11 KV for the FIG. 2 arrangement.

A spacer 22 was constructed according to the teachings of the invention, having a dielectric constant of 1.7. The test setup shown in FIG. 2 was then duplicated, using this low dielectric constant spacer, and the corona inception voltage was 30 KV. Thus, a designer of gas and vapor cooled electrical inductive apparatus would be able to use the construction techniques of liquid filled transformers, to obtain the necessary mechanical strength for withstanding short circuit forces without damage.

While the emphasis is placed on the value of the invention in gas and vapor cooled transformers, because of its tremendous advantages in this art, the invention also provides advantages in liquid filled electrical inductive apparatus, as it enables the liquid and solid insulation to be stressed more closely to its insulating capability, resulting in size reductions which reduce weight and cost of the apparatus.

Figure 3:
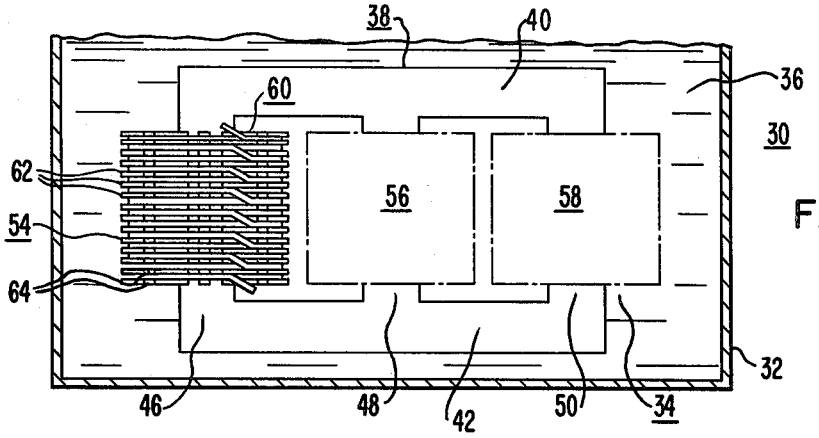
FIG. 3 is an elevational view of electrical inductive apparatus surrounded by a fluid insulating dielectric, which may be constructed according to the teachings of the invention.

Before describing the invention in detail, power transformer apparatus which may benefit from the invention will first be described. FIG. 3 is a diagrammatic representation of a three-phase, fluid filled electrical power transformer 30 of the core-form type which may utilize the invention. Transformer 30 includes a tank or enclosure 32 having a magnetic core-winding assembly 34 disposed therein, which is surrounded by an insulating and cooling fluid dielectric 36. Dielectric 36 may be air, a gas which is non-condensible within the normal operating temperature range of transformer 30, such as nitrogen or $SF_6$, or an insulating and cooling liquid such as mineral oil, or silicone oil. The magnetic core-winding assembly 34 includes a magnetic core 38 having upper and lower yoke portions 40 and 42, respectively, which are interconnected by spaced, parallel leg portions 46, 48 and 50. Phase winding assemblies 54, 56 and 58 are disposed in inductive relation with leg portions 46, 48 and 50, respectively. Each winding assembly includes concentrically disposed low voltage and high voltage windings, with the low voltage winding being disposed within the high voltage winding. The high voltage winding is made up of a plurality of interconnected pancake coils. For example, winding assembly 54 includes a high voltage winding 60 having a plurality of pancake coils 62 spaced vertically apart via radial spacer members 64.

Figure 4:
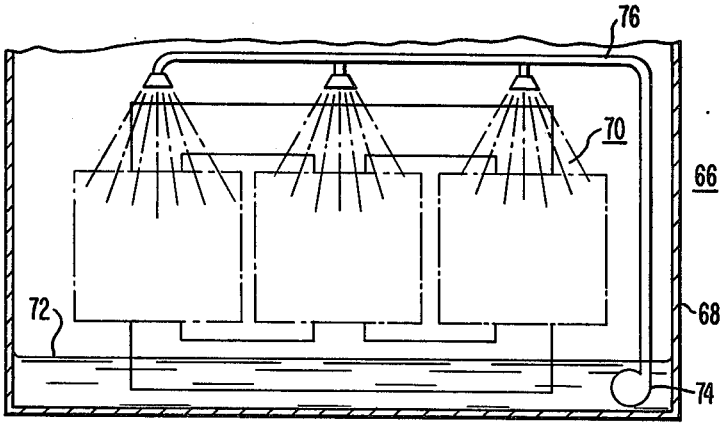
FIG. 4 is an elevational view of vapor cooled electrical inductive apparatus which may be constructed according to the teachings of the invention.

FIG. 4 is a diagrammatic representation of a three-phase fluid filled power transformer 66, which is similar to transformer 30 of FIG. 3, except for the insulating and cooling dielectric. Transformer 66 includes a tank or casing 68 having a magnetic core-winding assembly 70 disclosed therein, and a liquid, such as $C_2Cl_4$, $C_8F_{16}O$, or the like, which is vaporizable within the normal operating temperature range of the magnetic core-winding assembly 70. The liquid 72 is distributed over the magnetic core-winding assembly 70 by any suitable means, such as via a pump 74 and piping means 76. In addition to the vapors of liquid 72, tank 68 may include a non-condensible gas, such as $SF_6$, to provide insulation during startup of the transformer 66.

Figure 5:
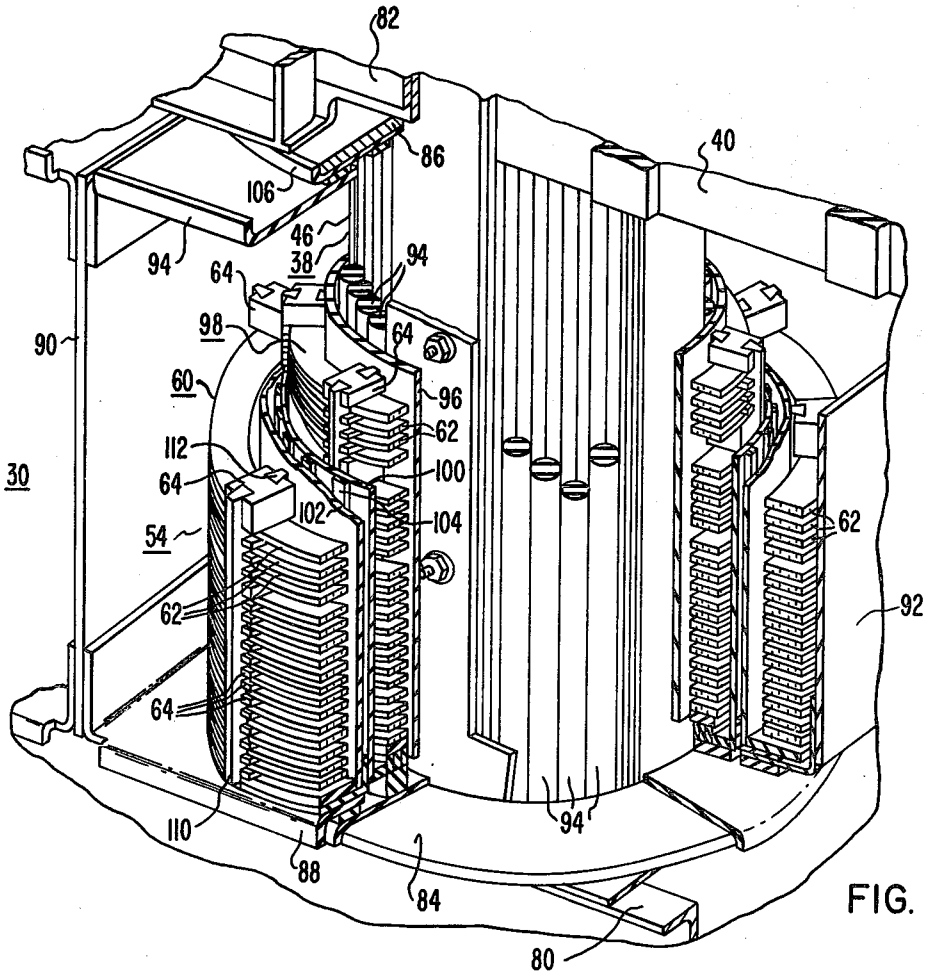
FIG. 5 is a perspective view, partially cut away, of an electrical winding assembly constructed according to the teachings of the invention, which may be used for the winding assemblies of the electrical apparatus shown in FIGS. 3 and 4.

FIG. 5 is a perspective view of winding assembly 54, shown partially cut away, illustrating different types of insulating structures which may be advantageously constructed according to the teachings of the invention.

The magnetic core 38 is provided, on each side thereof, with lower channel members 80, and upper channel members 82, between which the winding assemblies 54, 56 and 58 are clamped. A pressure plate 84 rests on the lower channel members 80, while an upper pressure plate 86 abuts against the bottom of the upper channel members 82. Phase insulation barriers of solid insulation are provided to isolate each of the transformer phase winding assemblies from each other. The barriers comprise a rectangular, flanged bottom sheet 88, insulating side walls 90 and 92, which are fastened to the bottom sheet 88, and a flanged top sheet 94, which is also fastened to the walls 90 and 92, forming a rectangular compartment. The transformer tank walls usually close the open front and rear sides of the compartment.

As illustrated, the legs of the magnetic core may be of cruciform construction, with insulating filler rods or strips 94 being disposed in the various corners thereof. The filler strips 94 support a cylindrical tube or shell 96 of solid insulation, which tube supports and electrically insulates a low voltage winding assembly 98.

A cylindrical insulating tube or shell 100 is placed over the low voltage winding assembly 98, and then a larger insulating tubular member 102 is placed about tubular member 64, with vertical spacing strips 104 being introduced in a predetermined pattern in the space between the tubular members 100 and 102. The vertical spacer strips fit tightly into the space to enable the tubes to strengthen one another, while enabling a surrounding insulating dielectric to flow freely between the tubular members when the transformer is in operation.

The high voltage winding 60 is then applied over the tubular member 102. Radial spacer members 64 are disposed between each pancake coil 62 of the high voltage winding 54. The radial spacers are circumferentially spaced about each pancake coil, 6 to 8 inches apart, and the spacers of each level are vertically aligned with spacers of other levels. The radial spacers are interconnected via vertical insulating members 110 and 112. The radial spacers may have trapezoidal shaped openings at each end thereof, and the members 110 and 112 may be shaped accordingly, to tightly fit these openings, to form a mechanically strong structure.

A thin insulating tube (not shown) may be applied over the outside of the winding 60, to direct the flow of the dielectric.

After both the high voltage winding 60 and low voltage winding 98, as well as the several insulating tubular members 96, 100 and 102, are placed around the magnetic core leg 46, the upper rectangular insulating sheet member 94 is placed over the top pancake coil of the high voltage winding 60. A flanged solid insulating ring 106 and the pressure plate 86 are then disposed on top of the windings. The remaining portion of the magnetic core comprising the horizontal upper yoke portion 40 is then assembled on the vertically extending leg portions. The upper channel members 82 are placed into position, and suitable bolts may be applied to bolt the channels firmly to the magnetic core.

Any one or all of the structural insulating members of transformers 30 may be constructed according to the teachings of the invention, such as the insulating tubular members 96, 100 and 102, the vertical support members 94, the vertical spacers 104, radial spacers 106 and the interconnecting vertical members 110 and 112, and any other of the insulating forms shown. In addition to these insulating members, which are related to a three-phase circular core-form transformer, the teachings of the invention may be applied to any single or multiphase power transformer or electrical reactor, circular or rectangular core-form construction, or shell-form construction, wherein the insulating structures, including layer and turn insulation, may benefit from having a structural insulating member or barrier member which has a relatively low dielectric constant.

The invention relates to electrical inductive apparatus of power generating frequency, having electrical conductors at elevated potentials, and insulating structures for supporting and electrically insulating them. The insulating structure is formed of an adhesive or binder, such as an organic resin, filled with microspheres. Microspheres are hollow spheres which are so small that their diameters are measured in microns. They have a very thin wall which surrounds air, and thus, although the wall is made of glass or silica, the dielectric constant of a microsphere approaches that of air, i.e., 1. Microspheres may be deliberately manufactured of glass, or they may be recovered from fly ash as a by-product of smoke stack cleaning systems of electrical utilities. Manufactured microspheres are commercially available from 3M under the trade name "Microballoons", for example, and from Emerson and Cuming, Inc. under the trade name "Eccospheres". The fly ash by-product is available from Fillite of U.S.A., for example, under the name "Fillite", and also from various electrical power companies, such as Northern States Power Company. The fly ash microsphere is a glass-hard silicate in the form of a high strength hollow sphere. It is formed when powdered coal is used for firing the boilers of steam generators.

The manufactured microspheres, in general, have a thinner wall than the fly ash microsphere, and thus they have a lower dielectric constant than the fly ash microsphere. On the other hand, the fly ash microsphere will not crush as easily, and it is much less costly than the glass manufactured microspheres.

The size of the microsphere is not critical, as long as the microspheres are not so large that corona is formed within the sphere. In general, microspheres having a diameter of 100 microns, or less, have proven excellent, but it is conceivable that larger microspheres may be adequate, as large as 300 microns, or larger, depending upon the voltage stress that the insulating structure having the microspheres will be subjected to.

The adhesive binder is selected to provide the mechanical strength and chemical compatibility required for the specific application and operating environment. The adhesive binder is not critical, with the polyester and epoxy resins both giving excellent results, electrically, mechanically and chemically. The polyester resins are particularly compatible with fluorocarbons, and the epoxies are compatible with most other insulating dielectrics. The binder may also be elastomeric with suitable thermal and chemical characteristics.

The concentration of the microspheres, by weight, in the insulating system, is also not critical. The binder has a certain dielectric constant, usually between 3 and 4, and the microspheres are added in the amount necessary to provide the desired dielectric constant for the resulting product. Usually, the desired dielectric constant will be "as low as possible", and thus the upper limit is the point where the mixture will become adhesive starved. This point is about 70 to 75% microspheres by weight. It is also believed that a concentration below about 25% by weight would provide very little benefit. Thus, a practical range would be about 25 to 75% microspheres by weight, with excellent results being obtained with concentrations of about 35 to 50% by weight. Below 35% by weight, a thixotropic agent is required, in order to turn the liquid resin to paste and prevent phase separation between the liquid binder and the microspheres. Manufactured glass microspheres will float, and fly ash microspheres will sink, again illustrating the different wall thicknesses of the two types of microspheres.

The process of manufacturing the insulating members according to the invention is also not critical, as long as low shear mixing or stirring is used to blend the ingredients. High shear stirring, such as with roller or pebble mills, may crush the microspheres. Excellent products electrically, as well as mechanically, are obtainable without vacuum processing. The various insulating shapes may be formed by molding, casting, extruding or pultruding. The resulting mixture is similar to that of wet sand, enabling even fairly complex shapes to be formed. The green and cured dimensions are substantially identical, even when cured without the benefit of a mold.

Radial spacers were constructed according to the teachings of the invention, having an epoxy binder and 35% by weight of 3M's grade B38-4000 glass Microballoons. The "38" represents 0.38 grams/cc and the "4000" indicates the microballoons of this grade are rated 4000 psi i.e., 90% survival in an isotactic press (fluid hydraulic pressure) at 4000 psi. Radial spacer members were also constructed with an epoxy binder and 44% by weight of Fillite (fly ash microspheres). Tests were made on both types of spacers in $SF_6$ gas at 1 atmosphere and room temperature, with the test producing the results listed in Table I below:

TABLE I

| Composition | Spacer Thickness | Dielectric Constant | % Dissipation Factor | Corona (kV) Incep. | Corona (kV) Ext. | Impulse (kV) Hold | Impulse (kV) Fail |
|---|---|---|---|---|---|---|---|
| 40% Fillite (Low Temp. Epoxy) | .495 inch | 2.96 | 0.9 | 22 | 20.5 | 135 | 143 |
| 35% Glass Microballoons (High Temp. Epoxy) | .467 inch | 2.82 | 1.3 | 27 | 25 | 144 | 154 |
| 35% Glass Microballoons (High Temp. Epoxy) | .496 inch | 2.16 | 2.0 | 31.5 | 30.0 | 135 | 151 |
| 35% Glass Microballoons (Low Temp. Epoxy) | .452 inch | 2.21 | 1.0 | 29.5 | 28.5 | 124 | 142 |

Mechanical tests indicate a compressive strength above 6000 psi, with sufficient spring-back to provide tight coils.

Examples of suitable compositions for radial spacers are as follows:

| Example No. 1 | Wt. % |
|---|---|
| Adhesive Binder - Shell 828 (epoxy) | 49 |
| Hardener or Catalyst - Tricresyl borate and triethanol amine titanate (1:1 by wt.) | 4.9 |
| Thixotropic Agent - Cab-O-Sil | 1.6 |
| Microspheres - 3M's B38-4000 | 44.8 |
| Wetting Agent - 3M's FC430 | trace |
| **Example No. 2** | **Wt. %** |
| Adhesive Binder - P.D. George 433-70-S (rigid polyester) | 50 |
| Hardener - Tertiary Butyl Perbenzoate | 0.5 |
| Thixotropic Agent - Cab-O-Sil | 4.0 |
| Microspheres - 3M's B38-4000 | 45.5 |
| Wetting Agent - 3M's FC430 | trace |
| **Example No. 3** | **Wt. %** |
| Adhesive Binder - P.D. George 332-85-VT (flexible polyester) | 50 |
| Hardener - Tertiary Butyl Perbenzoate | 0.5 |
| Thixotropic Agent - Cab-O-Sil | 4.0 |
| Microspheres - 3M's B38-4000 | 45.5 |
| Wetting Agent - 3M's FC430 | trace |

The syntactic foam compositions of these examples were made by charging the resin into a one liter glass resin flask, adding the catalyst and the surface active agent and stirring the mixture with a portable mixer. Although a thixotropic agent is not essential with the concentrations of the above mentioned examples, Cab-O-Sil was added with stirring and the microspheres were added in four incremental portions, each of which were stirred to produce a homogeneous mixture. The final product had the appearance and texture of damp sand and could be pressed into a solid shape by finger pressure. A charge of 45 grams of the mixture was placed in a 4"×4-¼" square mold and compressed to form a flat board at a pressure of 1,000 psi at room temperature. The flat slab was ejected from the mold and cut to a 1½"×3" block by means of a sheet metal cutter. Trapezoidal cuts were made at each end by means of a second small cutter. The pieces were placed between mold release treated pieces of plate glass to preserve the flatness of the spacers (about 1 psig pressure) and oven cured at 145° C. The spacers prepared in this manner had flat sides and a thickness of 0.250±0.005 inch. A cured sample spacer made from each of the three sample compositions withstood a pressure of 20,000 lbs. (4,450 psig) without crushing or cracking.

A practical process for preparing radial spacers of the above mentioned type might, for example, prepare the mixture in a Baker Perkins bent arm or a Werner-Pfleider ribbon type dough mixture, extruding it into a flat ribbon using a screw type extruder, cutting the ribbon into flat spacers having trapezoidal shaped end slots, and curing the spacers in an oven between pieces of glass or sheet metal. Cures may also be obtained in high frequency or microwave fields.

The green strength of the resulting syntactic foam composition can be varied over wide limits by varying the Cab-O-Sil content or by using resinous thixotropic agents. The dielectric constant is varied by changing the microsphere content, and the resin binder may be either a homogeneous or heterogeneous catalyst cross-linked epoxy resin, a rigid or flexible polyester resin, or any other low curing pressure resin. High pressure, high temperature cure solids resins may also be used if the molding pressures are such that there is little or no attrition (breaking) of the microspheres. An advantage of this process is the fact that any green offal generated may be reprocessed, making the operation scrapless.

We claim as our invention:

1. Electrical inductive apparatus, comprising:

an enclosure, an electrical winding in said enclosure adapted for connection to an electrical potential at power frequency, said electrical winding having areas of high electrical stress when connected to the electrical potential, dielectric means in said enclosure surrounding said electrical winding, said dielectric means having a predetermined dielectric constant which does not exceed about 2.2, an insulating structure for said electrical winding including solid insulating means, said insulating structure being disposed to add mechanical strength to at least certain of said areas of high electrical stress in said electrical winding, with said insulating structure having a compressive strength exceeding about 6000 psi and sufficient spring-back to retain winding tightness following short circuit mechanical stresses, said solid insulating means including an adhesive binder having a dielectric constant in the range of about 3 to 4 and a filler which includes microspheres having a dielectric constant of about 1.

said adhesive binder and said filler being selected to provide a dielectric constant for said solid insulating means which is substantially less than the dielectric constant of said adhesive binder alone, the concentration of said filler in said insulating structure being in the range of 25 to 75% by weight, and wherein the diameter of said microspheres is 100 microns, or less, to provide the requisite compressive strength and spring-back characteristics without breakage of the microspheres, and a corona inception value compatible with the electrical operating potential.

2. The electrical inductive apparatus of claim 1 wherein the microspheres are fly ash microspheres.

3. The electrical inductive apparatus of claim 1 wherein the solid insulating means includes an insulating member which projects from the electrical winding into the dielectric means.

4. The electrical inductive apparatus of claim 1 wherein the dielectric means is a gas having a dielectric constant of about 1.

5. The electrical inductive apparatus of claim 1 wherein the dielectric means is a gas having condensible and non-condensible constituents, with said gas having a dielectric constant of about 1.

6. The electrical inductive apparatus of claim 1 wherein the dielectric means includes $SF_6$ gas.

7. The electrical inductive apparatus of claim 1 wherein the microspheres are hollow spheres formed of a silicate.

8. The electrical inductive apparatus of claim 1 wherein the adhesive binder is an epoxy resin.

9. The electrical inductive apparatus of claim 1 wherein the adhesive binder is a polyester resin.

10. The electrical inductive apparatus of claim 1 wherein the electrical winding includes a plurality of spaced electrical coils, with the solid insulating means including a plurality of spacer members disposed to provide and maintain the space between said coils.

11. The electrical inductive apparatus of claim 1 wherein the dielectric means is a liquid.

* * * * *